United States Patent [19]

Diaz-Silveira

[11] Patent Number: 4,879,554

[45] Date of Patent: Nov. 7, 1989

[54] BARRIER ASSEMBLY FOR A PARKING SPACE

[76] Inventor: Jorge Diaz-Silveira, 9817 NW. 4th Ter., Miami, Fla. 33172

[21] Appl. No.: 167,667

[22] Filed: Mar. 11, 1988

[51] Int. Cl.[4] ..... G08G 1/14

[52] U.S. Cl. ..... 340/932.2; 49/49

[58] Field of Search ..... 340/51, 22, 114 B, 116, 340/117, 127, 138, 142, 932.2, 425.5, 908.1; 116/28 R, 63 R; 40/610, 612; 49/49, 33, 25

[56] References Cited

U.S. PATENT DOCUMENTS

| | | | |
|---|---|---|---|
| 3,849,936 | 11/1974 | Geraci | 49/49 X |
| 3,948,375 | 4/1976 | Selby, Jr. | 340/51 X |
| 4,318,079 | 3/1982 | Dickinson | 340/127 |
| 4,531,472 | 7/1985 | Marrero et al. | 116/28 R |
| 4,574,523 | 3/1986 | Nasatka | 49/49 |
| 4,713,910 | 12/1987 | Quante | 49/49 |

FOREIGN PATENT DOCUMENTS

| | | | |
|---|---|---|---|
| 2591261 | 6/1987 | France | 49/49 |

*Primary Examiner*—Joseph A. Orsino
*Assistant Examiner*—Brian R. Tumm
*Attorney, Agent, or Firm*—Malloy & Malloy

[57] ABSTRACT

A barrier assembly used to selectively prevent unauthorized automobiles and like vehicles from entering a parking space wherein a barrier portion of the subject assembly is selectively positionable preferably through use of a remote control activated system, between a blocking and retracted position and further wherein the retracted position allows the authorized vehicle to pass thereover for parking within the designated space. The assembly may include spikes to puncture tires when in a blocking position or a warning sign or both.

14 Claims, 2 Drawing Sheets

BARRIER ASSEMBLY FOR A PARKING SPACE

BACKGROUND OF THE INVENTION

1. Field of the Invention

This invention relates to a barrier assembly for an automobile or like vehicle parking space which is preferably remotely controlled and having portions thereof selectively positionable between a blocking position to prevent access of a vehicle to the parking space and a retracted position wherein access thereto is allowed.

2. Description of the Prior Art

In many highly populated areas parking space, particularly for automobiles, as well as other vehicles, is generally considered to be scarce. Accordingly, it is common at certain business, industrial and residential facilities to effectively "reserve" parking spaces by placing an identifying name, number, etc. on a parking curb. Technically, only authorized vehicles are thereby allowed to park in the specifically designated and appropriated spaces. However, due to the aforementioned overcrowded conditions, unauthorized vehicles frequently park in spaces specifically reserved for others. This is not only annoying to the operator of the authorized vehicle but is frequently time consuming and costly if such operator is forced to park in another area or is required to contact the authorities to have the unauthorized vehicle removed.

In order to overcome problems of the type set forth above, the use of portable barriers has sometimes been resorted to. Such portable barriers may be commonly referred to as "saw horses" wherein such structures are temporarily positioned within the parking space until the authorized vehicle arrives. However, this type of easily movable and portable structure is generally considered to be inconvenient since an unauthorized person can also remove the "saw horse" from the parking space and occupy the space. Also, safe storage of such a structure becomes a problem and theft may be a frequent occurrence.

Another more permanently installed barrier structure is disclosed in the U.S. Pat. No. 4,531,472 to Marrero, et al. Therein, a combined indicator and blocking assembly is structured for mounting on the ground or surface within a designated parking space. The subject structure as disclosed therein includes a head portion positionable upwardly from a base or enclosure mounted on the parking space surface wherein the head portion is supported upwardly in blocking relation to the entry of a vehicle by collapsible support structures While certainly applicable and effective for its intended function, such a structure still necessitates the use of an authorized operator stopping the car, exiting the vehicle and manually positioning the structure into or out of its blocking position, dependent upon whether the vehicle operator is entering or leaving the parking space.

Similarly, the U.S. Pat. No. 3,061,960 to Dull, discloses a reserved parking post which also is intended to provide means to block or prevent the entrance to a parking space and comprises an elongated post-like structure which may assume a substantially vertical position for blocking of unauthorized vehicle entry or a substantially horizontal position which permits an automobile or like vehicle to be driven into the parking space It should be noted that both of the structures disclosed in the aforementioned patents must be manually operated and in at least one of the structures set forth above certain connections or disconnections need be accomplished.

Accordingly, in view of the problems associated with the parking of vehicles in reserved areas becoming more acute, there is still a need for a more conveniently operable barrier assembly which preferably can be operated by remote control for selective positioning into and out of a blocking position so as to prevent or allow entry of a vehicle into and out of the parking space effectively guarded by the subject barrier assembly.

SUMMARY OF THE INVENTION

The present invention is directed towards a barrier assembly specifically designed to be mounted in and effectively protect the entry of unauthorized vehicles, such as automobiles, from parking within a designated parking space. In a preferred embodiment of the present invention, to be described in greater detail hereinafter, the barrier portion of the subject assembly is selectively positionable between a blocking position and a retracted position through operation of a remote control structure used in combination with the subject barrier assembly.

By virtue of the operation of the preferred remote control system, an operator of a vehicle may operate the barrier assembly causing the barrier portion thereof to be selectively disposed either in the blocking position or the retracted position so that the operator may either enter the automobile into the parking space or exit from the parking space and activate the barrier assembly accordingly without himself having to leave the confines of the vehicle. This of course differs from known prior art structures and includes certain advantages which are obviously recognizable.

The remote system referred to may be of a variety of types generally commercially available and include a transmitting unit being portable and carried with the operator within the authorized vehicle. This transmitting unit is designed to operate on radio frequency, infra red, etc. and thereby cooperate with a receiving unit attached to or connected with a drive means associated with the subject barrier assembly.

Drivingly connected to the drive means, which preferably is an electrically powered reversible drive motor, is a barrier means. The barrier means comprises an elongated support portion preferably having an indicating structure or enhanced barrier structure attached generally to one end thereof. The overall dimension and configuration of both the support portion and any indication structure attached thereto is such as to be substantially elongated. This elongated configuration will present a formidable barrier and thereby block or prevent the access or entry of an unauthorized automobile or like vehicle into the space since the automobile will not be able to pass over the barrier structure or support portion without severely damaging it. On the other hand, when the drive motor of the drive means is activated by the control means which, may include the above set forth remote control assembly, it may be selectively positionable into a retracted position. The retracted position is more particularly defined by a substantially horizontal position and a "low to the ground" disposition such that the automobile will be able to readily pass over the barrier assembly without damage or contact thereto.

Powering of the drive motor may occur using a variety of facilities. Such may include a plurality of batteries wherein the motor would be a direct current drive motor. Alternately, the drive motor could be an alternating current drive motor and proper electrical conductors or like structures could connect the drive motor directly to a common electrical power supply present in a building or like facilities. Yet another embodiment to be described in greater detail hereinafter could be a solar panel electrical conversion assembly wherein energy is received from the sun and converted into electrical power to be supplied to the drive motor.

All of the above set forth components are preferably mounted on a high strength low weight base structure which may be secured directly at "ground level" within the space or alternately mounted within some type of weatherproof housing surrounding the various components. In any event, an anchoring facility is utilized to penetrate the exposed surface of the parking area and extend into the interior of whatever support material, ground, etc. is used to support the vehicle. It therefore should be readily apparent that the subject structure could be used in any one of a number of reserved exterior parking paces or alternately, within multi-level or floor parking garages.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
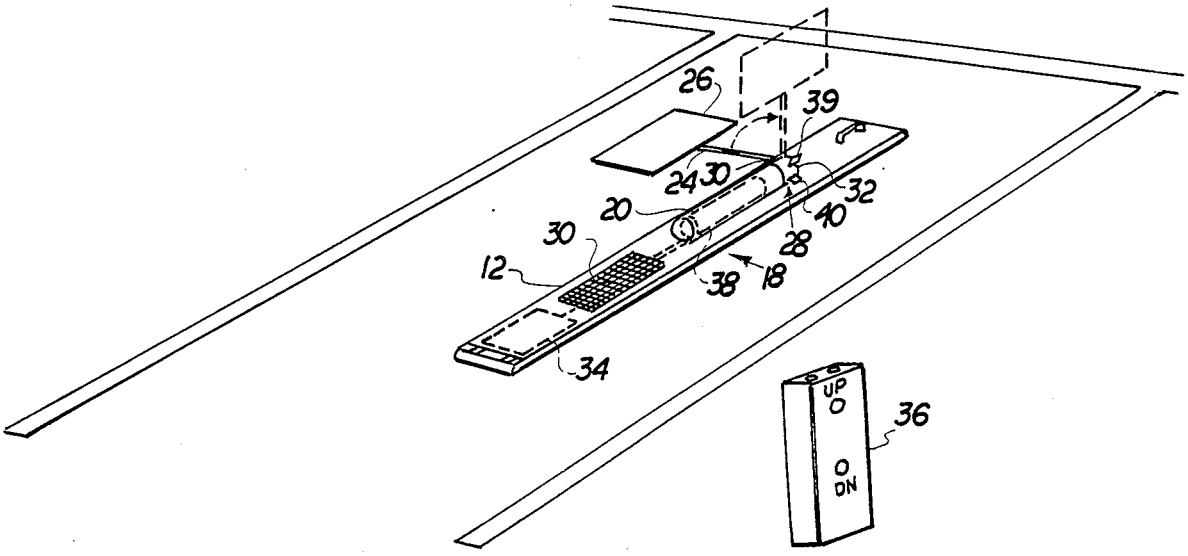
FIG. 1 is an exploded view in perspective of the various important components of the present barrier assembly.
Figure 2:
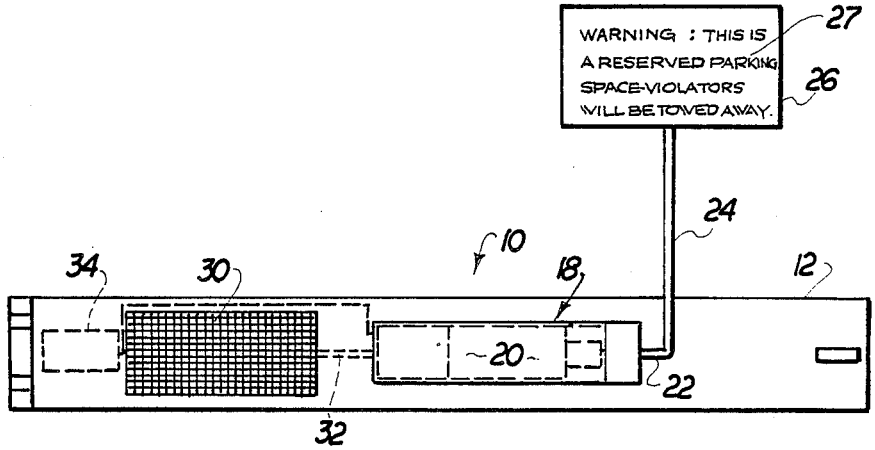
FIG. 2 is a perspective view of certain ones of the components mounted on a supporting base.
Figure 3:
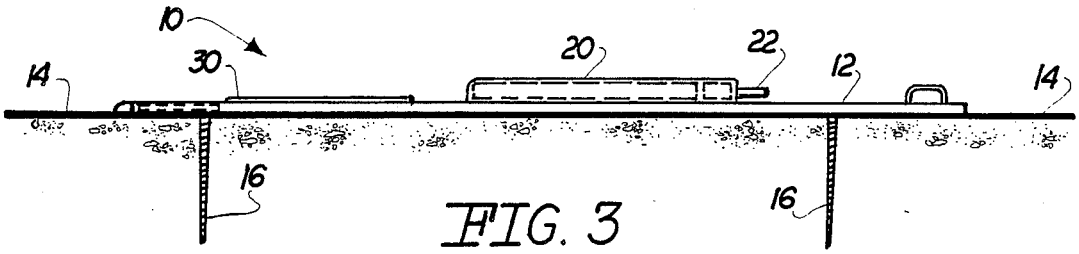
FIG. 3 is a longitudinal side view showing anchoring facilities associated with the base for securing the subject barrier assembly within a designated parking space.

As shown in FIGS. 1, 2 and 3, the present invention is directed towards a barrier assembly generally indicated as 10 and including a base portion 12 which may be anchored or otherwise secured to a supporting surface 14 such as the ground or other surface on which a designated parking space for an automobile is outlined. With regard to FIG. 3, the present invention includes anchor means including at least one but preferably a plurality of anchor structures 16 secured to the base 12 and extending downwardly beyond an undersurface thereof so as to penetrate the supporting surface 14 to a depth sufficient to securely anchor the base 12 in a designated position within the boundaries of the outlined parking space. In the embodiment of FIG. 3, the anchor structure 16 may include two auger style rods as indicated.

The assembly of the present invention further includes a drive means generally indicated as 18 and including a drive motor 20 which is preferably electrically driven by a predetermined electrical power supply. The drive motor 20 is a reverse type motor serving to drivingly rotate a drive shaft 22 in either of two opposite directions. The barrier means of the present invention includes a support portion 24 preferably having an elongated configuration and further including an indication structure or means 26 attached preferably at one end thereof by any conventional manner. The support portion 24 and the connecting drive shaft 22 is secured in driven relation to the drive motor by a clutch mechanism generally indicated as 28 in FIG. 1. The clutch mechanism may include a drive plate 30 frictionally engaging a driven plate 32 such that upon engagement therebetween, the support portion 24 is rotatable between the blocking position or a retracted position. The blocking position is represented, in phantom lines in FIG. 1, wherein the support portion 24 and the indicating means 26 is shown in a substantially vertical or at least partially vertical or upright position which would prevent entrance of an automobile into the space. To the contrary, the retracted position is shown in FIGS. 2 and 3 wherein the support portion 24 and indicating means or structure 26 is shown in a substantially horizontal "low to the ground" position such that an automobile may easily pass thereover. Accordingly, it should be obvious that the length of the support portion 24 is such that when it is in its upright or vertical orientation it serves as a barrier. The height or length of the support portion 24 would prevent passage of the automobile thereover without damaging or coming into direct contact with the support portion 24 and indicating means 26. As shown clearly in FIG. 2, the indicating means could have various informative indicia 27 on an exposed surface thereof so as to clearly indicate to any unauthorized driver or operator of a vehicle that the space is in fact reserved especially when the support portion and indicating means 26 is in in the aforementioned upright blocking position.

A power supply means is preferably in the form of a solar panel 30 mounted on the base 12 as clearly shown in FIGS. 2 and 3 as at 32 to the drive motor 20 and/or any applicable circuitry therewith so as to convert the sun's radiant energy into electrical power which is connected directly to the drive motor 20 for operation thereof.

In order to activate the drive means 18 or more specifically the drive motor 20, a preferred control means includes a remote control assembly including a receiving unit 34 and a transmitting unit 36. The receiving unit 34 may be mounted on the base or otherwise connected to the power supply and/or the drive motor so as to activate it through proper switching. Such switching of course would take into effect necessary connections to whatever power supply source is in fact used. The transmitting unit 36 would of course be portable and carried with the authorized vehicle and so as to be accessible and operable by the driver thereof.

As the driver either approaches the space or leaves the space, the transmitting unit 36 would be activated so as to position the support portion 24 and indicating means 26 between the blocking position and the retracted position depending upon whether the authorized vehicle is entering the space or leaving the space.

Other than the solar panel assembly 30 defining the power supply means, a conventional dry cell battery or like may be utilized as at 38. Another alternative would of course be a regular conventional a.c. power source (not shown for purposes of clarity).

Other features of the invention associated generally with the control means would be limit switches as at 39 and 40 such that the power supply to the drive motor 20 and/or activation thereof would automatically cease upon the limit switches 39 and 40 engaging one another. The limit switches 39 and 40 would be preset so as to orient the support portion 24 and indicating means 26 in the preferred vertically upright locking position. Similar limit switches could be also properly positioned other than the specific switches 39 and 40 so as to deactivate the motor 20 when in the retracted position as clearly shown in FIGS. 2 and 3.

Figure 4:
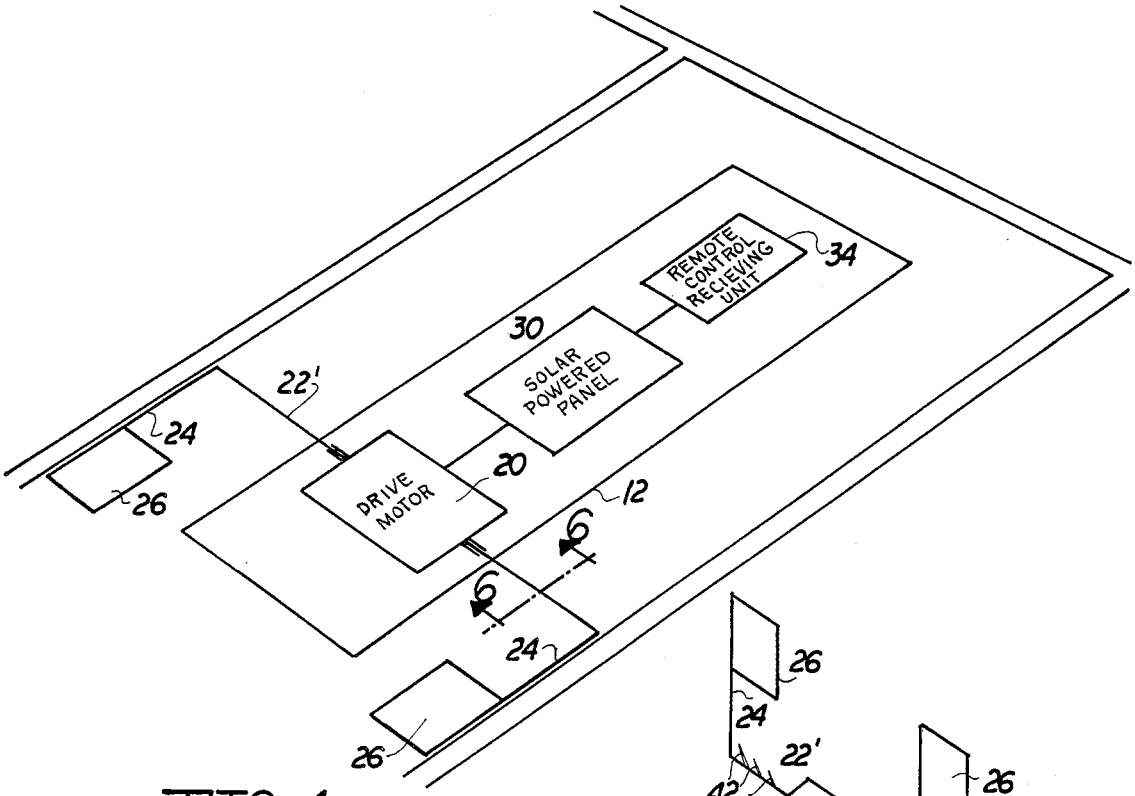
FIG. 4 is a schematic perspective view of another embodiment of the barrier assembly shown in its retracted position.
Figure 5:
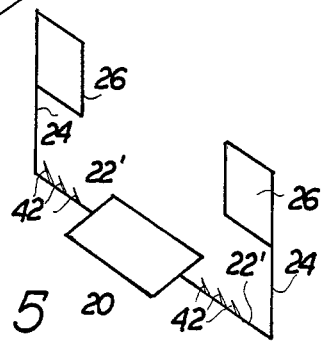
FIG. 5 is a perspective view in partial cutaway of the barrier assembly shown in its blocking position.
Figure 6:
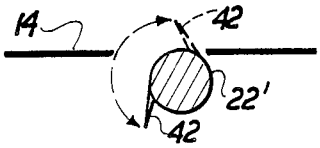
FIG. 6 is a sectional view along lines 6—6 of FIG. 4 showing structural details of certain components of the present invention.

An alternative embodiment is shown in FIGS. 4 and 5 and 6 wherein two indicating means 26 are mounted on individual support portions or shafts 24 and each being supported by connecting shafts 22'. One difference clearly recognizable in the embodiment of FIGS. 4 through 6 is the transverse orientation of the drive motor 20 and the transverse outward extension of the connecting shafts 22'. In such an embodiment, when the assembly is in its blocking position as shown in FIG. 5, pointed spikes or like elements 42 are arranged on the shafts 22' so as to be angled outwardly for penetrating engagement with the tires of the vehicle when any such vehicle attempts to pass through and damage the barrier assembly when in its blocking position as shown in FIG. 5.

With regard to FIG. 6, the connecting shafts 22' are shown recessed into the supporting surface 14 so that the vehicle tires may pass readily thereover without damage thereto when the assembly is in its retracted position as shown in FIG. 4. It should be noted that other components such as the indicating means 26, support portions 24 as well as the connecting shaft 22' may also be recessed into the supporting surface 14 so that the tires of the vehicle may pass readily thereover without damage thereto as intended. Proper gearing or linkage mechanism, well known in the prior art, can be associated with the driving mechanism of the drive motor 20 for purposes of allowing a single drive motor to operate both of the connecting shafts 22' in the manner indicated above. Other components of the assembly as explained with regard to the embodiments of FIGS. 1 through 3 may be also maintained on the base 12 and operated in the same manner.

When activated, the drive motor rotates approximately 90° to bring the indicating means 26 to their upright blocking position as shown in FIG. 5. Since it is preferred that the penetrating, protecting spikes 42 be disposed somewhat at an angle for easy penetration into the tires of a vehicle as shown in FIGS. 5 and 6, the spikes 42 are mounted somewhat beyond a 90° orientation so that a 90° rotation of the shafts 22' will position the spikes 42 into their operative, penetrating position as represented in phantom lines in FIG. 6 as 42 and in full solid lines in FIG. 5.

Now that the invention has been described,

What is claimed is:

1. A barrier assembly designed to guard a parking space for an automobile and prevent entry therein of an unauthorized vehicle, said barrier assembly comprising:

(a) a base secured within the parking space substantially at ground level and dimensioned to include a height sufficient to allow passage of an automobile thereover, (b) barrier means movably mounted on said base and selectively positionable between a blocking position and a retracted position for selectively blocking or allowing access to the parking space, (c) drive means mounted on said base and connected to said barrier means for positioning thereof between said blocking position and said retracted position, (d) power supply means connected to said drive means for providing activating power thereto, (e) control means connected to said drive means and structured for activation thereof and selected disposition of said barrier means between said blocking position and said retracted position, (f) said barrier means comprising two support portions each having an elongated configuration and each being interconnected to said drive means by a different connecting shaft, each of said connecting shafts extending outwardly from said drive means in substantially opposite directions from one another and rotatably driven by said drive means between said blocking position and said retracted position, and (g) said support portions being dimensioned to allow passage thereover of a vehicle into the parking space when the barrier means is disposed in said retracted position.

2. An assembly as in claim 1 wherein said control means comprises a remote control assembly including a portable, remotely disposable transmitting unit carried by an authorized vehicle and a receiving unit interconnected to said drive means for selective activation thereof.

3. An assembly as in claim 2 wherein said transmitting unit and said receiving unit are cooperatively structured to activate said drive means and selectively dispose said barrier means between said blocking and retracted positioned upon activation of said transmitting unit.

4. An assembly as in claim 1 wherein said drive means comprises an electrically powered motor connected to said power supply means and drivingly engaging said connecting shafts, said connecting shafts drivingly connected to said barrier means for selective disposition of said support portions between said blocking position and said retracted position.

5. An assembly as in claim 4 wherein said motor is reciprocably drivable in either of two opposite directions and is connected to said control means for selective activation of said motor, said motor structured for rotation of said connecting shafts and rotational driving interconnection thereof with said support portions.

6. An assembly as in claim 5 wherein said support portions are rotationally positionable between a substantially upright, vertical orientation when said barrier means is disposed in said blocking position and a substantially reclined, horizontal orientation when said barrier means is disposed in said retracted position.

7. An assembly as in claim 1 wherein said power supply means comprises a solar powered panel assembly structured to generate electricity upon the exposure of said panel to solar energy, said panel electrically connected to said drive means.

8. An assembly as in claim 1 wherein said power supply means comprises a dry cell battery assembly and said drive means comprises a direct current reversible motor, said dry cell battery assembly being electrically connected in power delivering relation to said motor.

9. An assembly as in claim 1 further comprising anchor means secured to said base and extending outwardly therefrom into penetrating relation to a supporting surface on which the parking space is formed for securing said base to the support surface and within the parking space.

10. An assembly as in claim 9 wherein said anchor means comprises a plurality of anchor structures secured to said base in spaced relation to one another and extending outwardly from an undersurface thereof into penetrating and secured engagement with the supporting surface.

11. An assembly as in claim 1 further comprising spike means mounted on each of said connecting shafts and movable therewith between an exposed position and a non-exposed position for penetration of an automobile's tires when said spike means are in said exposed position.

12. An assembly as in claim 11 wherein said connecting shafts and said spike means are disposed in substantially recessed relation to a supporting surface of the parking space on which the vehicle rests.

13. An assembly as in claim 12 wherein said spike means comprises a plurality of spaced apart spikes formed on each of said connecting shafts and disposed in a substantially angular orientation relative to the supporting surface in a preferred penetrating relation to tires of the automobile passing thereover.

14. An assembly as in claim 1 further comprising indicating means secured to each of said support portions at an outer end thereof and movable between said blocking position and said retracted position upon activation of said drive means.

* * * * *